US008935818B2

(12) United States Patent
Rohr

(10) Patent No.: US 8,935,818 B2
(45) Date of Patent: Jan. 20, 2015

(54) BREAKAWAY ADJUSTABLE BED SYSTEM

(71) Applicant: L&P Property Management Company, Southgate, CA (US)

(72) Inventor: William Rohr, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 45 days.

(21) Appl. No.: 13/659,532

(22) Filed: Oct. 24, 2012

(65) Prior Publication Data

US 2014/0109313 A1 Apr. 24, 2014

(51) Int. Cl.
*A47C 23/00* (2006.01)

(52) U.S. Cl.
USPC ..... 5/282.1; 5/285; 5/286; 5/288

(58) Field of Classification Search
CPC .. A47C 19/005; A47C 19/021; A47C 19/022; F16B 12/58; F16B 12/54; F16B 12/56; A61G 1/003
USPC ..... 5/282.1, 285, 286, 288, 292–294, 296, 5/200.1, 201, 904, 905, 940
See application file for complete search history.

(56) References Cited

U.S. PATENT DOCUMENTS 1,444,950 A * 2/1923 Cook ..... 5/298
3,691,330 A * 9/1972 Hollander ..... 200/61.19
4,231,030 A * 10/1980 Weiss ..... 340/686.1
4,536,754 A * 8/1985 Holce et al. ..... 340/568.2
4,536,925 A * 8/1985 Boothe et al. ..... 24/511
4,577,185 A * 3/1986 Andersen ..... 340/573.4
4,617,689 A * 10/1986 Nelson et al. ..... 5/400
4,858,622 A * 8/1989 Osterweil ..... 600/595
5,233,707 A * 8/1993 Perkins ..... 5/8
6,407,353 B1 * 6/2002 Fritzinger et al. ..... 200/334
2005/0228300 A1 * 10/2005 Jaime et al. ..... 600/485
2009/0313758 A1 * 12/2009 Menkedick et al. ..... 5/618

* cited by examiner

*Primary Examiner* — Robert G Santos
*Assistant Examiner* — Myles Throop
(74) *Attorney, Agent, or Firm* — Shook Hardy & Bacon L.L.P.

(57) ABSTRACT

Provided is breakaway adjustable bed system that includes a bed frame and a breakaway system. The bed frame includes at least one breakaway member. The breakaway system includes a coupling assembly, signal mechanism, control box and alarm devices. The coupling assembly includes elements that selectably couple a breakaway member to another member of the bed frame. The control box includes a processing unit that, upon sensing a signal from the coupling assembly or signal mechanism that the selectable coupling between the breakaway member and another member of the bed frame is decoupled, provides an indication to an alarm device. The alarm device sends an alert to a user that the selectable coupling between a breakaway member and a member of the bed frame is decoupled.

15 Claims, 7 Drawing Sheets

BREAKAWAY ADJUSTABLE BED SYSTEM

BACKGROUND OF THE INVENTION

An adjustable bed is a bed that has a multi-hinged lying surface. The adjustable bed may be profiled to various positions. Common adjustments include retracting the foot of a mattress away from a bed frame, inclining the upper body and raising the lower body independently of each other and adjusting the height of the adjustable bed.

During ordinary use of a conventional adjustable bed, mishaps may occur. For instance, an object may fall between the foot of a mattress and a bed frame that surrounds the mattress of an adjustable bed. Such mishaps may cause the conventional adjustable bed to cease working properly. Oftentimes a user may not be aware of conditions that may trigger the mishap and, therefore, may not be able to appropriately resolve the problematic condition prior to damage occurring to the bed frame. For example, in the case of an object falling between the mattress and the bed frame, the object may sustain damage itself or cause damage to the bed frame upon extending the foot of the mattress forward.

Accordingly, embodiments of the present invention introduce an improved "adjustable bed system" that limits potential damage caused by mishaps when adjusting the adjustable bed, as well as provides an alert to the user about an issue detected within the adjustable bed system.

BRIEF SUMMARY OF THE INVENTION

The present invention relates to innovative features that are applied to an adjustable bed system. Specifically, in some embodiments, the present invention concerns the adjustable bed system that includes breakaway member(s) and device(s) to notify a user when a breakaway member has detached from the adjustable bed system. In operation, the present invention may be used to solve one or more of the problems described above that adversely affect enjoyment and operation of a conventional adjustable bed, as well as other concerns and issues not described herein that relate to the industry of adjustable furniture.

One illustrative embodiment of the adjustable bed system includes a breakaway system for alerting a user of the adjustable bed system that a traverse member of a bed frame has detached from lateral member(s) of the bed frame. The breakaway system may include a coupling assembly, a control box, and alarm device(s). The coupling assembly selectively couples the traverse member with the lateral member(s). In addition, the coupling assembly communicates with the control box.

The control box includes a processing unit and other equipment. The processing unit senses a signal from the coupling assembly and provides an indication to alarm device(s) that the selectable coupling between the traverse member and the lateral member(s) is decoupled. The alarm device(s), upon sensing the indication from the processing unit, may attempt to send an alert to the user that the selectable coupling between the traverse member and the lateral member(s) is decoupled.

Another illustrative embodiment involves a coupling assembly for selectably coupling a traverse member with lateral member(s) of a frame unit (e.g., bed frame) for an adjustable bed. The coupling assembly includes a first element and second element. The first element is attached to a traverse member. The second element is attached to the lateral member(s). The second element is configured to release the selective coupling of the first element upon the application of a predefined amount of force to the traverse member.

In yet another illustrative aspect, an adjustable bed is capable of alerting a user that a traverse member has broken away. The adjustable bed includes a bed frame and a breakaway system. The bed frame houses a motor device coupled to linkage(s) that adjust the adjustable bed. The bed frame includes the traverse member and lateral member(s). In operation, the breakaway system selectably couples the traverse member and the lateral member(s).

The breakaway system includes a coupling assembly. The coupling assembly includes a first element attached to the traverse member and a second element attached to the lateral member(s). The bed assembly comprises a signal mechanism, control box and an alarm system. The signal mechanism detects the selectable coupling of the traverse member and the lateral member(s). The signal mechanism includes a coupling of a first component and a second component. The first component of the signal mechanism is attached to the traverse member and the second component of the signal mechanism is attached to lateral member(s). Upon decoupling of the first and second component, the signal is sent to the control box. The control box houses a processing unit. The processing unit, upon sensing a signal from the coupling assembly and/or the signal mechanism indicating that the selectable coupling between the traverse member and the lateral member(s) is decoupled, provides the indication to the alarm devices(s). In turn, the alarm device(s), upon sensing the indication from the processing unit, sends an alert to the user communicating that the selectable coupling between the traverse member and the lateral member(s) is decoupled.

Additional objects, advantages, and novel features of the invention will be set forth, in part, in the description that follows, and, in part, will become apparent to those skilled in the art upon examination of the following, or may be learned by practice of the invention.

BRIEF DESCRIPTION OF THE SEVERAL VIEWS OF THE DRAWINGS

The accompanying drawings, which form a part of the specification and are to be read in conjunction therewith, and, with like reference numerals, are used to indicate like parts in the various views.

DETAILED DESCRIPTION

Figure 1:
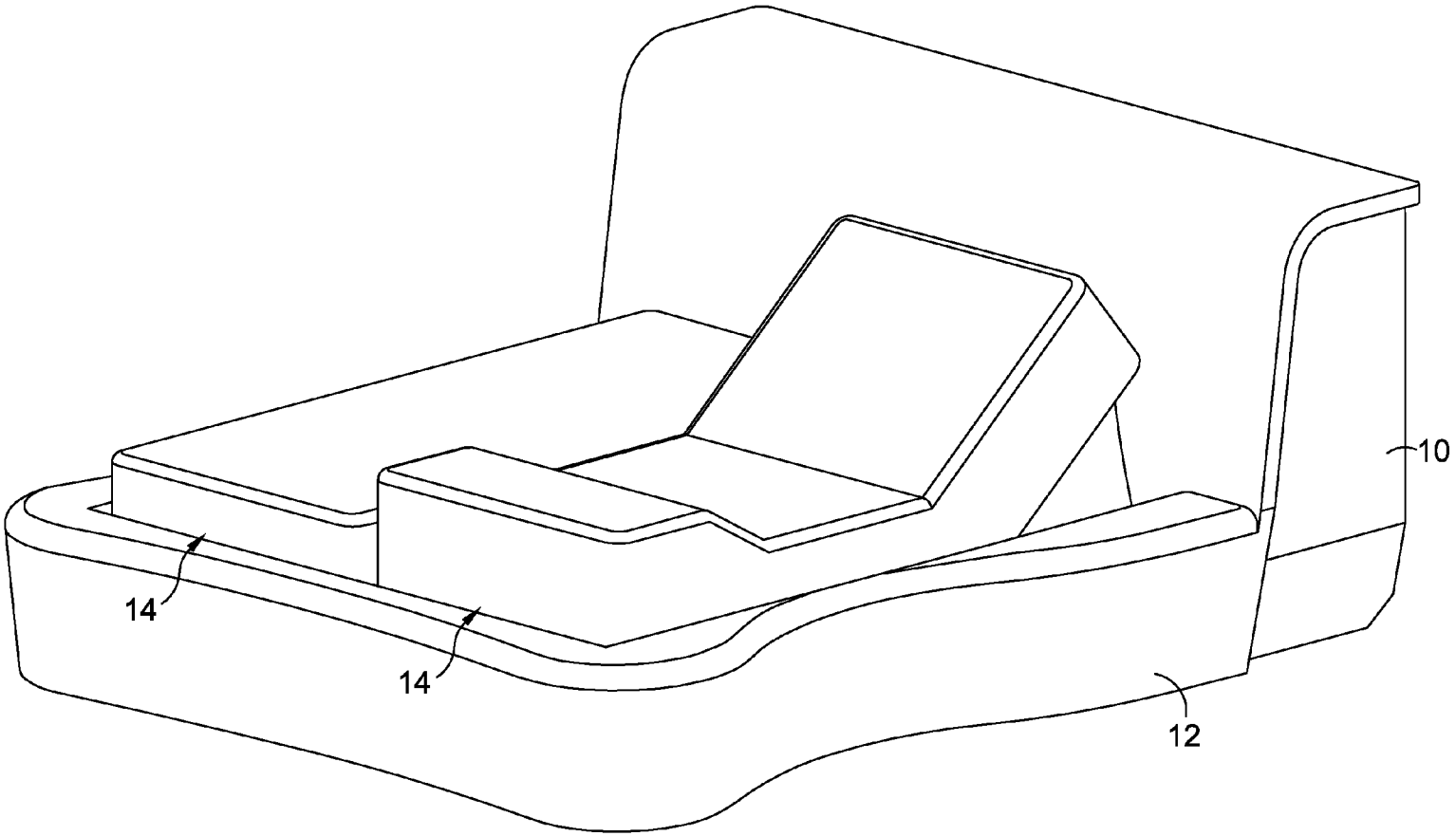
FIG. 1 shows a perspective view of an exemplary adjustable bed, in accordance with embodiments of the invention.

Referring first to FIG. 1, an illustrative embodiment of an adjustable bed system 10 is shown. The adjustable bed system 10 has a frame 12 designed to provide a structural base to the adjustable bed system 10, while vertically raising a linkage mechanism above an underlying surface. The frame 12 may be made of wood or other rigid materials known to those of skill in the furniture-manufacturing industry. In embodiments, a pair of adjustable bed 14 is coupled to the frame 12. It should be appreciated and understood that only one or multiple adjustable bed 14 could be used within the adjustable bed system 10, although only two are illustrated for demonstrative purposes.

In an embodiment, as shown in FIG. 1 a pair of twin adjustable bed 14 is provided. Each adjustable bed 14 is individually adjustable in relation to the other, to provide a "his" and "hers" style of recline/incline. That is, the adjustable beds 14 are adjustable to a number of different positions. For example, the head of the adjustable bed 14 may be raised, as may be the area of the bed adjacent to the knee area of the user. These adjustable beds are known generally to those in the bedding field.

Although not illustrated in FIG. 1, the linkages and or motor(s) associated with frame 12 are provided within the adjustable bed system 10. Generally, frame 12 houses motor devices(s) coupled to linkage(s). The coupled motors(s) and linkage(s) facilitate the adjustment of an adjustable bed, such as the adjustable bed 14.

Figure 2:
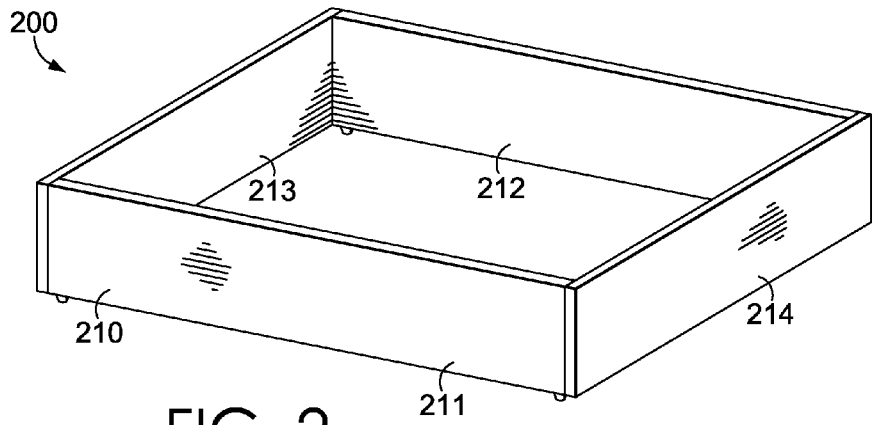
FIG. 2 shows a perspective view of a frame of a bed, in accordance with embodiments of the invention.

Referring now to FIG. 2, an illustration of frame 210 is shown. Frame 210 includes lateral members 211 and 212, and traverse members 213 and 214. Similarly to frame 12 in FIG. 1, Frame 210 also includes motor(s) and linkage(s) coupled to facilitate the adjustment of an adjustable bed that are not shown. It should be noted that the 'lateral' and 'traverse' member designations are interchangeable based upon an orientation of the frame 210. Thus, in some embodiments, lateral members 211 and 212 may be considered traverse members and the traverse members 213 and 214 may be considered lateral members.

Figure 3:
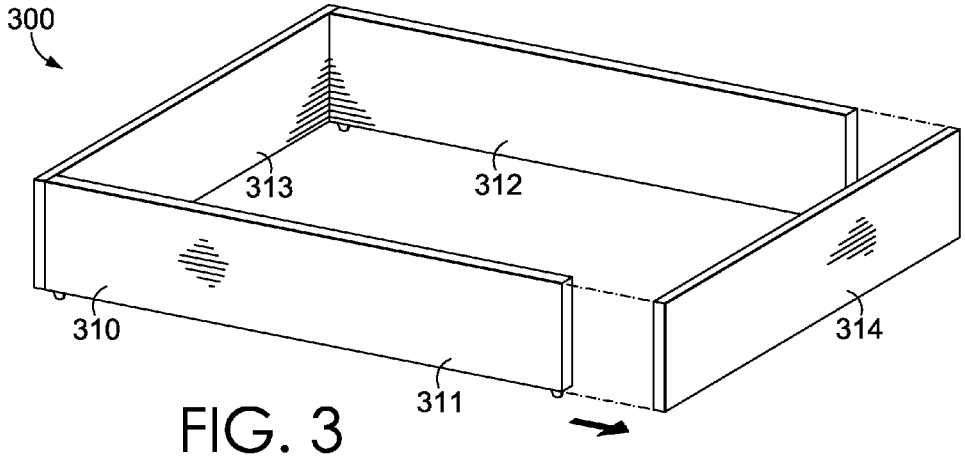
FIG. 3 shows an exemplary perspective view similar to FIG. 2, with a breakaway member of the bed frame released, in accordance with embodiments of the invention.

FIG. 3 shows frame 310. Frame 310 includes lateral members 311 and 312 and traverse members 312 and 314. Frame 310 also includes motor(s) and linkage(s) coupled to facilitate the adjustment of an adjustable bed that are not shown. FIG. 3 illustrates an embodiment of the present invention where a member of frame 310 is broken away. In this particular embodiment of the present invention, shown in FIG. 3, the traverse member 314 of frame 310 is broken away. As indicated above, any member of frame 310, such as lateral members 311, 312 or traverse members 313 or 314, may break away. In some embodiments, only one frame member of frame 310 may be capable of breaking away. In other embodiments, more than one frame member of frame 310 may be capable of breaking away. Further, in some embodiments, more than one member of frame 310 may be capable of breaking away; however, only one frame member may be broken away at one time. In other embodiments, more than one frame member of frame 310 may be capable of breaking away and more than one frame member may be broken away at one time.

Figure 4:
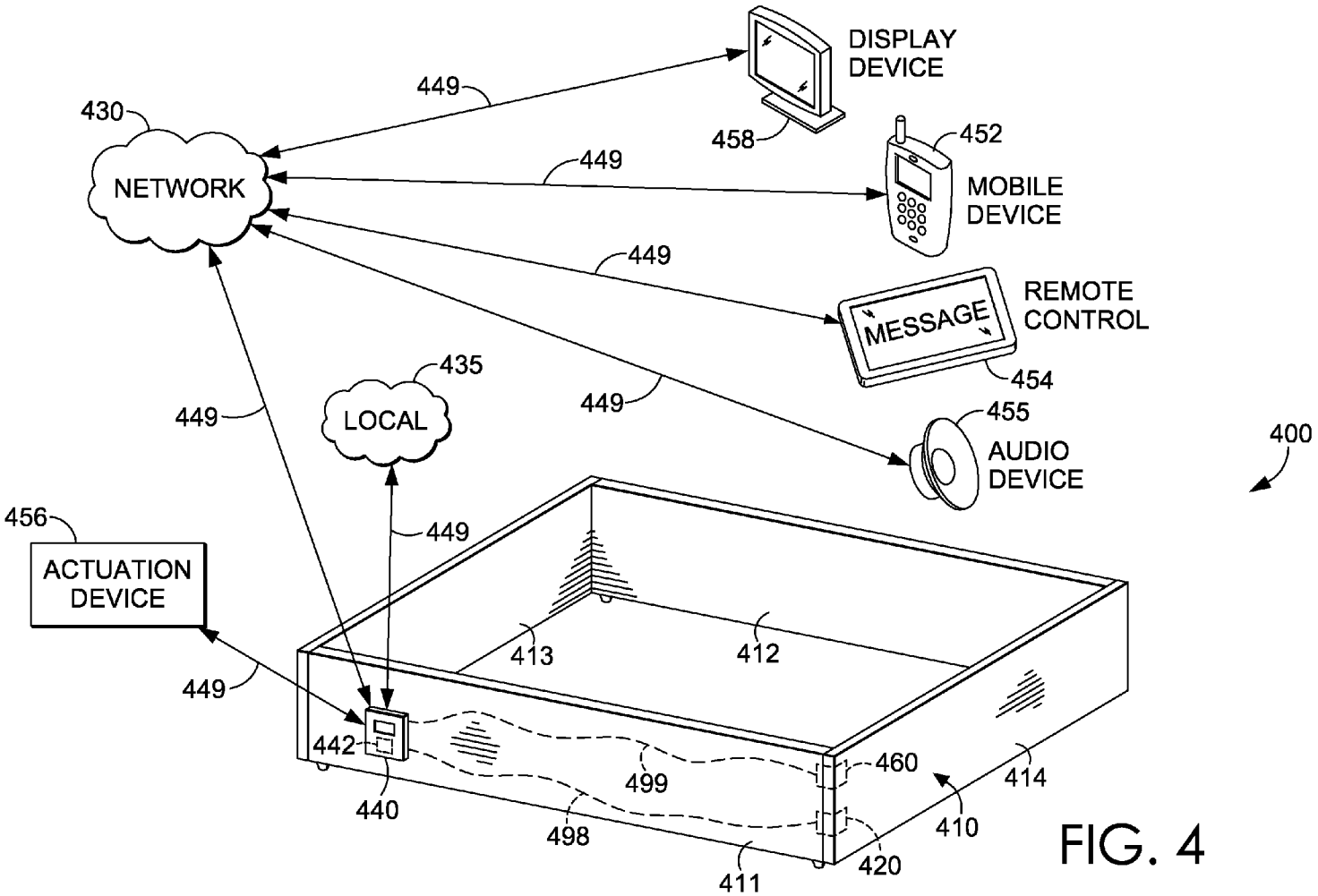
FIG. 4 shows a diagrammatic depiction of an exemplary adjustable-bed, breakaway system with various components interconnected via a network, in accordance with embodiments of the invention.

FIG. 4 provides an exemplary illustration of breakaway adjustable bed system 400. As shown, the breakaway adjustable bed system 400 includes a network 430 and/or local 435, a frame 410 and a breakaway system comprising multiple components. Network 430 and local 435 may include, without limitation, one or more local area networks (LANs) and/or wide area networks (WANs). Such networking environments are common place in offices, enterprise-wide computer networks, intranets and the Internet.

As shown in FIG. 4, frame 410 is similar to that of frame 300. As such, frame 410 includes lateral members 411 and 412 and traverse members 413 and 414, as well as motor(s) (not shown) and linkage(s) (not shown). Similarly to frame 300, the 'lateral' and 'traverse' member designations of frame 410 are interchangeable. Thus, in some embodiments, the lateral members 411 and 412 may be considered traverse members and the traverse members 413 and 414 may be considered lateral members.

The breakaway system, being associated with frame 410 and network 430 and/or local 435, provides for a lateral or transverse member of frame 410 to break away from frame 410. Said another way, the breakaway system provides for a transverse member, such as member 414, to decouple from at least one lateral member, such as member 411. Additionally, the breakaway system provides a user of the breakaway adjustable bed system to receive an alert that a member has broken away from the frame 410. The breakaway system includes a coupling assembly 420, control box 440 and one or more alarm devices 452, 454, 455, 456, 458 and other alarm devices not shown. In some embodiments, the breakaway system may also include a signal mechanism 460.

Figure 5:
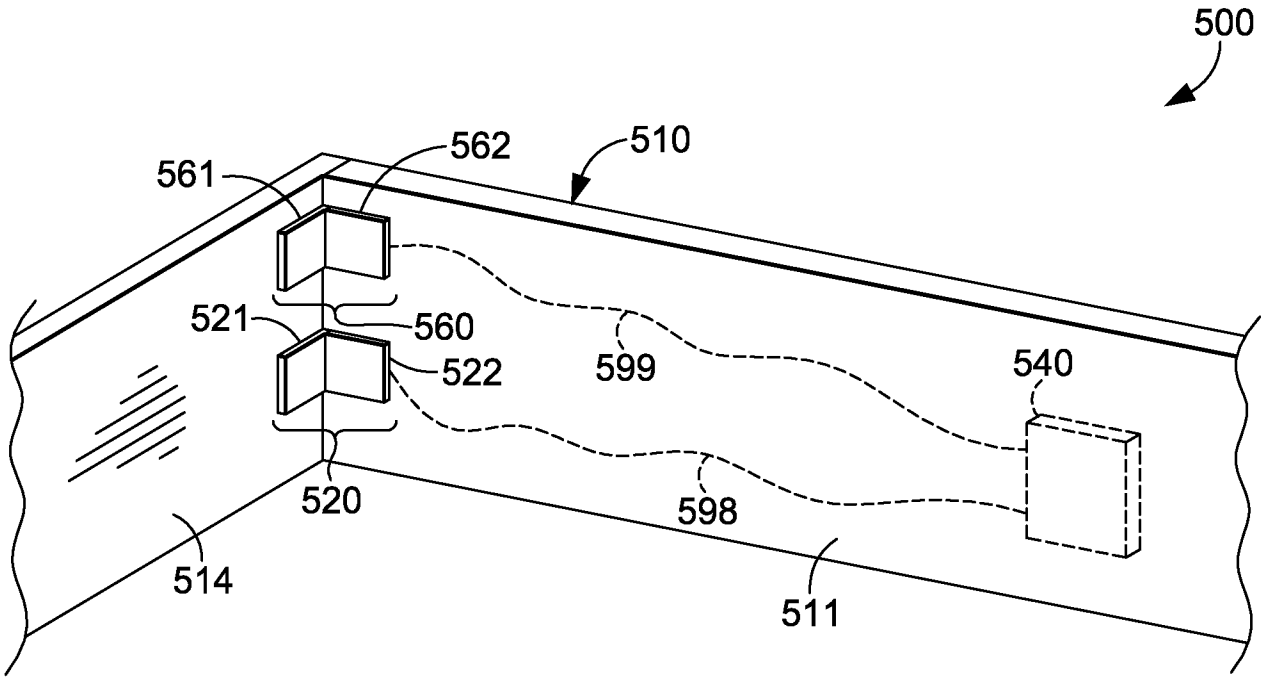
FIG. 5 shows a perspective view of components included in a breakaway system located at an interior of the bed frame, in accordance with embodiments of the invention.

FIG. 5 shows an interior view of frame 510. Frame 510 is similar to that of frame 410. FIG. 5 shows only one traverse member 514 and one lateral member 511; however, frame 510 includes a traverse member 513 and a lateral member 512 that are not shown. FIG. 5 also shows an interior view of the coupling assembly 520. The coupling assembly 520 facilitates the coupling of a traverse member, such as member 514 to a lateral member, such as member 511. The coupling assembly 520 includes a first element 521 and a second element 522. In one embodiment, the first element 521 is attached to traverse member 514 and the second element 522 is attached to lateral member 511. In other embodiments, the first element 521 is attached to lateral member 511 and the second element 522 is attached to traverse member 514. Additionally, the coupling assembly 520 maybe attached to any other members of a frame 510. When the traverse member 514 of frame 510 is selectably coupled to the lateral member 511 of frame 510, the first element 521 of coupling assembly 520 is connected to the second element 522 of coupling assembly 520.

In one embodiment, the coupling assembly 520 may comprise a snap latch. In such embodiment, the first element 521 may be a beam with a bump that deflects and snaps into a grove or slot of a mating part. The mating part is the second element 522, which includes a grove or slot configured to snap on to the first element 521. As such, when the traverse member 514 of frame 510 is selectably coupled to the lateral member 511 of frame 510, the first element 521 of coupling assembly 520 is connected to the second element 522 of coupling assembly 520 such that the mating parts of the snap latch are interconnected.

Figure 6A:
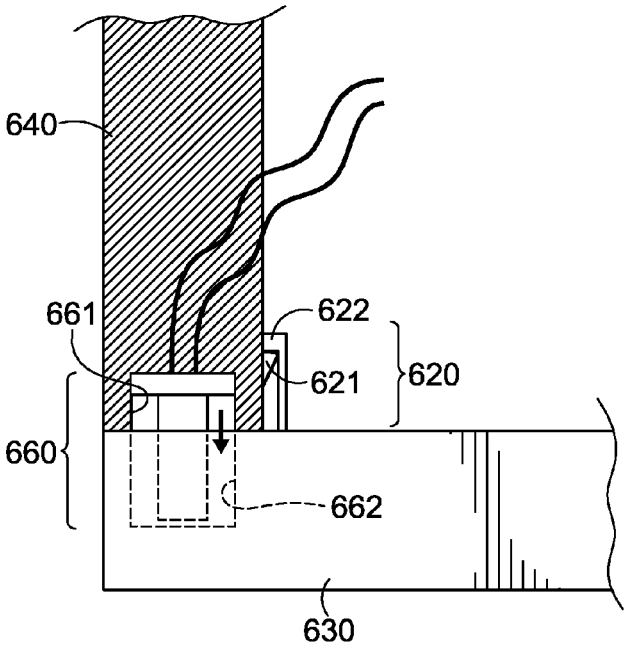
FIG. 6A shows a lateral view of the bed frame with a cut-away portion exposing a coupling assembly that includes a snap-latch assembly and a signal mechanism, where the members of the bed frame are attached, in accordance with embodiments of the invention.
Figure 6B:
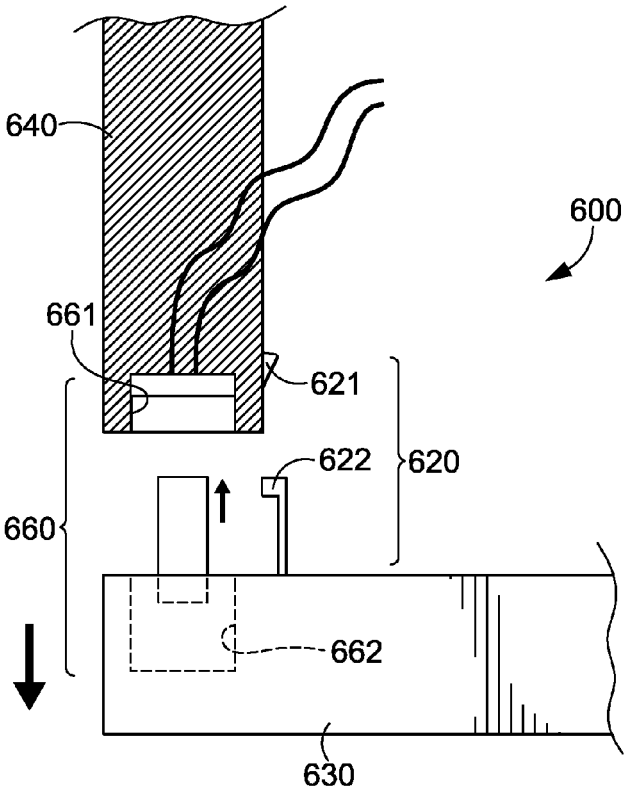
FIG. 6B shows a lateral view similar to FIG. 6A, but with the members of the bed frame detached, in accordance with embodiments of the invention.

FIG. 6A provides an illustration of coupling assembly 620 comprising a snap latch assembly, with first element 621 and second element 622. FIG. 6A shows frame member 630 and frame member 640 as being coupled and, correspondingly, first element 621 and second element 622 being interconnected. FIG. 6B provides an illustration of frame member 630 and frame member 640 decoupled and, correspondingly, first element 621 and second element 622 being unconnected.

Referring back to FIG. 5, in another embodiment, coupling assembly 520 may comprise a magnet assembly. In such embodiment, the first element 521 may be a magnet with a positive charge and the second element 522 may be a magnet with a negative charge. As such, when the traverse member 514 of frame 510 is selectably coupled to the lateral member 511 of frame 510, the first element 521 of coupling assembly 520 is magnetically coupled to the second element 522 of coupling assembly 520.

Figure 7A:
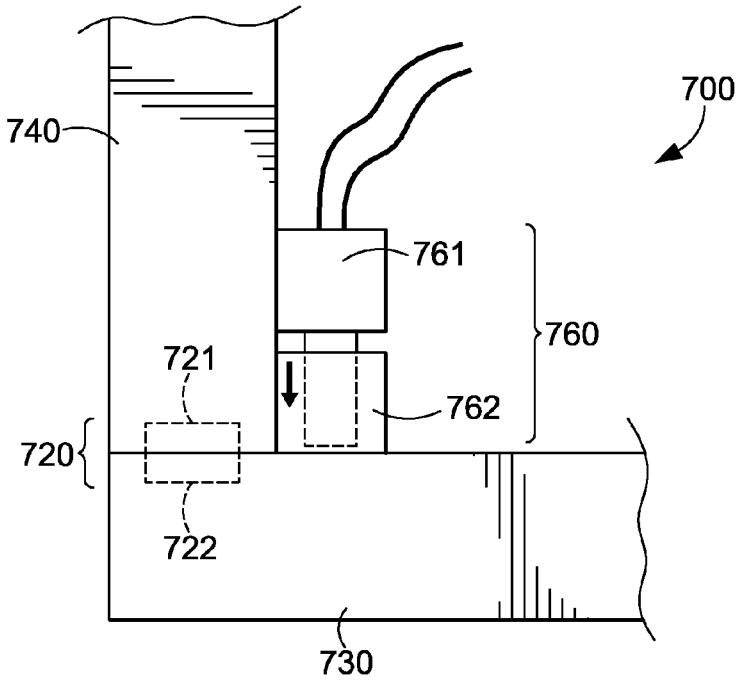
FIG. 7A shows a lateral view of the bed frame with a cut-away portion exposing the coupling assembly that includes a magnet assembly and a signal mechanism, where the members of the bed frame are attached, in accordance with embodiments of the invention.
Figure 7B:
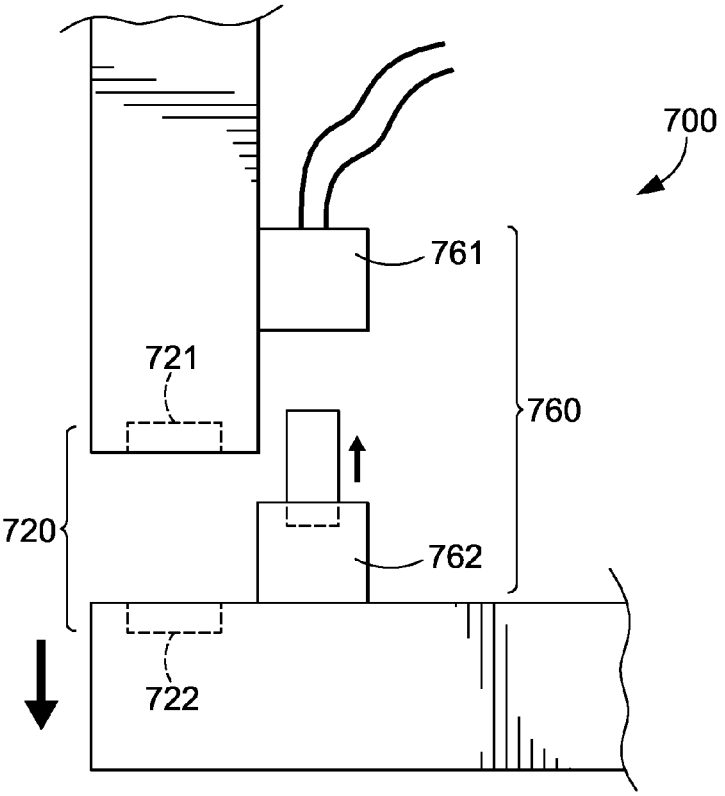
FIG. 7B shows a lateral view similar to FIG. 7A, but with the members of the bed frame detached in accordance with embodiments of the invention.

FIG. 7A provides an illustration of coupling assembly 720 comprising a magnet assembly. FIG. 7A shows member 730 and member 740 as being coupled and correspondingly, first element 721 and second element 722 being magnetically coupled. FIG. 7B provides an illustration of member 730 and member 740 decoupled and, correspondingly, first element 721 and second element 722 being separated and non-magnetically coupled.

Figure 8A:
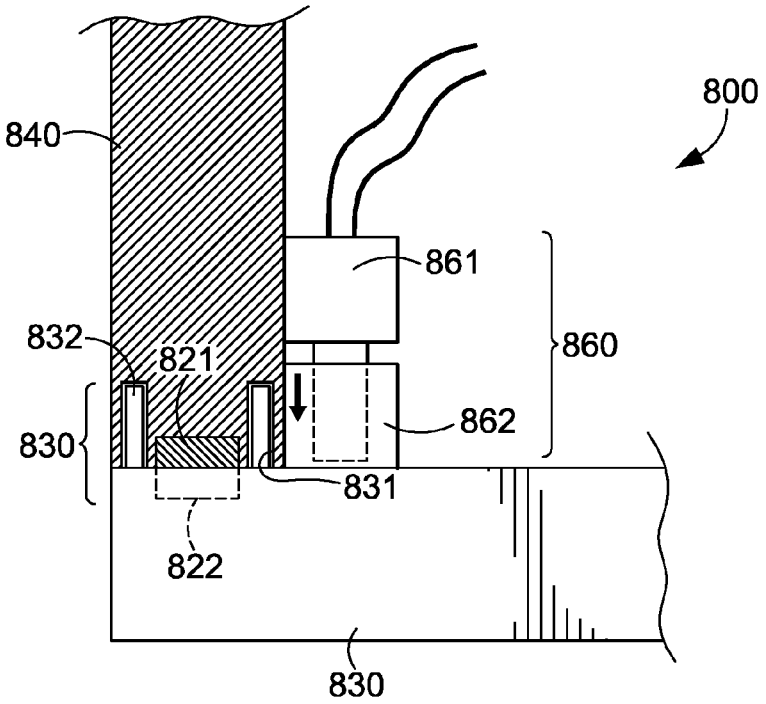
FIG. 8A shows a lateral view of a bed frame with a cut-away portion exposing the coupling assembly that includes a magnet assembly and a guide assembly, where the members of the bed frame are attached, in accordance with embodiments of the invention.
Figure 8B:
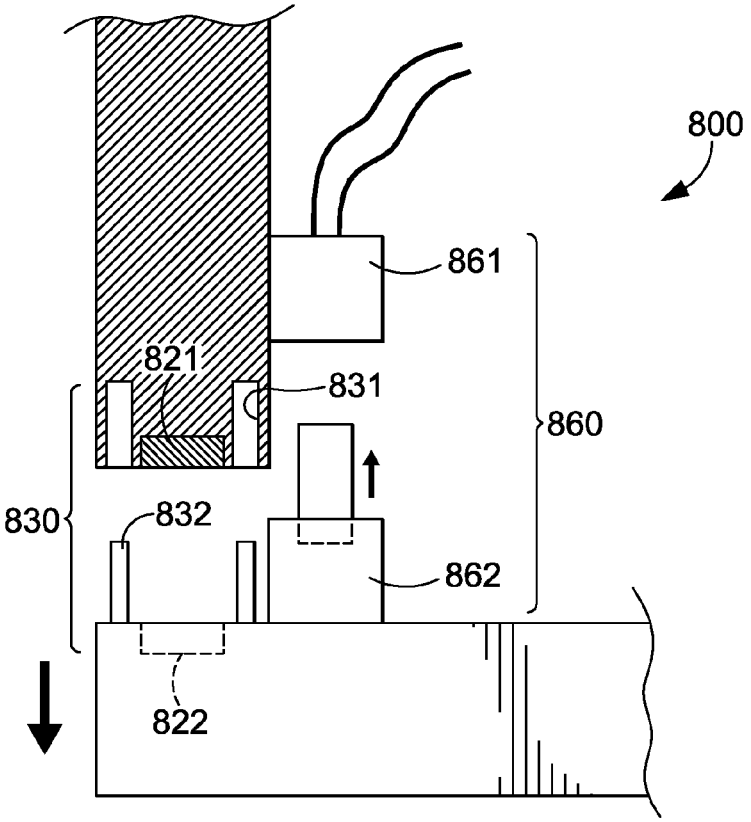
FIG. 8B shows a lateral view similar to FIG. 8A, but with the members of the bed frame detached in accordance with embodiments of the invention.

Referring back to FIG. 5, in some embodiments, the coupling assembly 520 may also include a guide assembly. The guide assembly may include a slot and corresponding pin. The interaction between the slot and pin of the guide assembly facilitates the alignment of the first element 521 and second element 522 of the coupling assembly 520, and thus the alignment of the traverse member 514 and the lateral member 511. FIG. 8A shows an exemplary embodiment of a guide assembly 830. The guide assembly 830 includes at least one slot 831 and corresponding pin 832. In additional to the guide assembly, FIG. 8 shows an exemplary embodiment comprising a magnet assembly 820 and a signal mechanism 860, to be described in detail below. As can be seen, the alignment of the magnet assembly 820 and signal mechanism 860 may be facilitates by the positioning of pin 832 into slot 831 of guide assembly 830.

In yet another embodiment, the coupling assembly includes a means to provide a signal 598 to a control box 540, as shown in FIG. 5, the signal providing an indication that a lateral or traverse member has broken away from frame 510. In some embodiments, the means by which a coupling assembly may provide a signal includes a circuit. In one embodiment, the coupling assembly 520 includes a magnetic sensor in a circuit.

In some embodiments of a breakaway system, a signal mechanism is included. A signal mechanism provides a signal to a control box, such as the control box 440 in FIG. 4. The signal 499 is provided from the signal mechanism to a control box when a traverse member, such as traverse member 414, is no longer coupled to a lateral member, such as lateral member 411. Referring to FIG. 5, signal mechanism 560 includes a first component 561 and a second component 562. The first component 561 is attached to the traverse member 514. The second component 522 is attached to the lateral member 511. In some embodiments, the first component 561 is attached to the lateral member 511 and the second component 562 is attached to the transverse member 514. In some embodiments, when the first component 561 and second component 562 meet, an electric circuit is complete. When the first component 561 and second component 562 are separated, the circuit in incomplete and signal 599 is sent to the control box 540.

Referring to FIGS. 6A and 6B, an illustration of a signal mechanism 660 is shown. The first component 661 is a hollow static component while the second component 662 includes a hollow member and a pin member. The pin member is slidably attached to the hollow member. The first component 661 and second component 662 are positioned such that, when frame member 630 is coupled to frame member 640, the first component 661 of signal mechanism 620 and the second component 662 of signal mechanism 620 meet, causing the slidably attached pin member to compress into the hollow member 662 and complete the electrical circuit. FIG. 6A provides an illustration of frame member 630 being coupled to frame member 640 and, correspondingly, first component 661 being connected to second component 662 and the circuit being complete. FIG. 6B shows member 630 being decoupled from member 640 and, correspondingly, first component 661 being separated from second component 662, causing the circuit to be incomplete. When the circuit is incomplete, a signal is sent to a control box.

Referring to back to FIG. 4, control box 440 houses processing unit 442. The processing unit 442 is configured to sense a signal 498 from coupling assembly 420 and/or a signal 499 from signal mechanism 460. Either or both signals 498 and 499 may be provided when a member of frame 410 has broken away from frame 410, or said another way, a frame member has decoupled from at least one other frame member. Upon the processing unit 442 sensing a signal from either the coupling assembly 420 or signal mechanism 460, the processing unit 442 provides an indication 449 to the alarm device(s). In one embodiment, the indication 449 may be provided through the network 430. In another embodiment, the indication 449 may be provided through the local 435. In yet another embodiment, the indication 449 may be provided through both the network and the local.

As mentioned above, the control box 440 includes, or is linked to, the processing unit 442, which represents some form of a computing unit (e.g., central processing unit, microprocessor, etc.) to support operations of the component(s), operating system(s), and/or application(s) running thereon (e.g., linkage-adjustment application or alarm-triggering software). As utilized herein, the phrase "computing unit" generally refers to a dedicated computing device with processing power and storage memory, which supports operating software that underlies the execution of software, applications, and computer programs thereon. In one instance, the computing unit is configured with tangible hardware elements, or machines, that are integral, or operably coupled, to the devices 452, 454, 455, and 458 to enable each device to perform communication-related processes and other operations (e.g., sending messages to devices, receiving input from sensors, and the like). In another instance, the computing unit may encompass a processor (not shown) coupled to the computer-readable medium accommodated by each of the devices 452, 454, 455, and 458. Generally, the computer-readable medium stores, at least temporarily, a plurality of computer software components that are executable by the processor. As utilized herein, the term "processor" is not meant to be limiting and may encompass any elements of the computing unit that act in a computational capacity. In such capacity, the processor may be configured as a tangible article that processes instructions. In an exemplary embodiment, processing may involve fetching, decoding/interpreting, executing, and writing back instructions.

An alarm device notifies a user of a breakaway adjustable bed system when a frame member has decoupled from another frame member. An alarm device may include, but is not limited to, a mobile device, audio device, display device, remote control and/or actuation device. A mobile device may be any portable device, such as, but not limited to, a cellular phone or laptop computer. A mobile device may be considered to comprise a display device and/or audio device. A remote control may be a remote control associated with the adjustable bed. In the event of a frame member decoupling from a frame, the alarm device(s) may broadcast an alert to the user, indicating that a member has decoupled from a frame. In some embodiments, a mobile device may present a visual alert, such as a text message, e-mail, or pop-up notification. In another embodiment, a mobile device may broadcast an audio alert, such as a phone call with a specified ring tone and/or a recorded audio message providing information related to the decoupling of a frame member. In yet another embodiment, an actuation device may provide an alert to the user by ceasing to adjust the adjustable bed and/or reversing the adjustment of the adjustable bed.

In some embodiments, determining factors are used to determine which of the alarm device(s) provides a user an alert. The determining factors include, but are not limited to: user preference, time of day, occupancy of the adjustable bed unit, and location of alarm devices. For instance, if the time of day is 11:00 a.m., one of the alarm devices selected to provide an alert may be a mobile device. If the time of day is 11:00 p.m., one of the alarm devices selected to provide an alert may be the remote control associated with the adjustable bed unit. In one embodiment, the processing unit 442 considers one or more determining factors. In another embodiment, one of the devices considers one or more determining factors.

A user may provide user preferences in relation to the alerts provided. A user may indicate in the user preferences which of the alarm devices the user would like to receive an alert from. Additionally, a user may indicate which type of alert, such as a text message or e-mail, the user would like to receive.

In some embodiments, the decoupled member may be recoupled. In one embodiment, the recoupling of a member may be performed manually. In another embodiment, the recoupling of a member may be performed automatically or at the instruction of a user through a remote control device. The manner in which a member may be recoupled may be selected by a user through the user preferences.

Many variations can be made to the illustrated embodiments of the present invention without departing from the scope of the present invention. Such modifications are within the scope of the present invention. Other modifications would be within the scope of the present invention.

The present invention has been described in relation to particular embodiments which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the method and apparatus. It will be understood that certain features and subcombinations are of utility and may be employed without reference to other features and subcombinations. This is contemplated by and is within the scope of the claims.

Since many possible embodiments of the invention may be made without departing from the scope thereof, it is to be understood that all matter herein set forth or shown in the accompanying drawings is to be interpreted as illustrative of applications of the principles of this invention, and not in a limiting sense.

What is claimed is:

1. A breakaway system for alerting a user that a first bed-frame member is detached from a second bed-frame member, the breakaway system comprising:

a first coupling-assembly element attached to the first bed-frame member;

a second coupling-assembly element that is attached to the second bed-frame member and that mates with the first coupling-assembly element;

a first signal component attached to the first bed-frame member;

a second signal component that is attached to the second bed-frame member and that mates with the first signal component when the first and second coupling-assembly elements are mated;

a control box in communication with the first signal component, wherein the first signal component sends a signal to the control box when the first signal component and the second signal component move from a coupled state to a decoupled state, and wherein the control box includes a processing unit that senses the signal and that provides an indication to one or more alarm devices indicating the first and second coupling-assembly elements are decoupled; and the one or more alarm devices that, upon sensing the indication from the processing unit, provide an alert that the first and second coupling-assembly elements are decoupled.

2. The breakaway system of claim 1, wherein the first and second coupling-assembly elements comprise a snap latch.

3. The breakaway system of claim 1, wherein the one or more alarm devices comprises a display device for providing a visual representation of the alert.

4. The breakaway system of claim 3, wherein the display device is a television monitor.

5. The breakaway system of claim 3, wherein the display device is integrated within a mobile device.

6. The breakaway system of claim 1, wherein the one or more alarm devices comprises an audio indicator broadcast on an audio device.

7. An adjustable bed that provides an alert when a first bed-frame member is decoupled from a second bed-frame member, the adjustable bed comprising:

a frame housing a motor device coupled to one or more linkages that adjust the adjustable bed, wherein the frame comprises the first bed-frame member and the second bed-frame member;

a breakaway system for coupling the first bed-frame member and the second bed-frame member, the breakaway system comprising:

a first coupling-assembly element attached to the first bed-frame member;

a second coupling-assembly element that is attached to the second bed-frame member and that mates with the first coupling-assembly element;

a first signal component attached to the first bed-frame member;

a second signal component that is attached to the second bed-frame member and that mates with the first signal component when the first and second coupling-assembly elements are mated;

a control box in communication with the first signal component, wherein the first signal component sends a signal to the control box when the first signal component and the second signal component move from a coupled state to a decoupled state, and wherein the control box includes a processing unit that senses the signal and that provides an indication to one or more alarm devices indicating the first and second coupling assembly elements are decoupled; and the one or more alarm devices that, upon sensing the indication from the processing unit, provide an alert that the first and second coupling-assembly elements are decoupled.

8. The adjustable bed of claim 7, wherein the processing unit is further configured to, upon sensing the signal, select an alarm device from the one or more alarm devices based on one or more determining factors.

9. The adjustable bed of claim 8, wherein the processing unit communicates the indication to the motor device housed by the frame when a condition is met.

10. The adjustable bed of claim 9, wherein the condition includes detecting that the adjustable bed is occupied, and wherein the motor device ceases adjusting when the motor device receives the indication.

11. The adjustable bed of claim 8, wherein the alarm device comprises a display device for providing visual representation of the alert.

12. The adjustable bed of claim 11, wherein the display device is integrated within a mobile device, and wherein the processing device communicates the indication to the mobile device when a time-based condition is met.

13. The adjustable bed of claim 11, wherein the display device is integrated within a remote control associated with the adjustable bed, and wherein the processing device communicates the indication to the remote control when the remote control is within a threshold distance away from the adjustable bed.

14. The adjustable bed of claim 8, wherein the alarm device comprises an audio device for providing an audio representation of the alert.

15. The adjustable bed of claim 14, wherein the audio device comprises a speaker, and wherein the processing device communicates the indication to the speaker when a time-of-day condition is met.

* * * * *